United States Patent [19]

O'Hare

[11] 4,427,350

[45] Jan. 24, 1984

[54] SOLAR DIAPHRAGM PUMP

[76] Inventor: Louis R. O'Hare, 1700 Banyan #3, Fort Collins, Colo. 80526

[21] Appl. No.: 338,283

[22] Filed: Jan. 11, 1982

[51] Int. Cl.[3] ..... F04B 17/00; F04B 43/06

[52] U.S. Cl. ..... 417/379

[58] Field of Search ..... 417/379; 60/531, 641.8, 60/641.15

[56] References Cited

U.S. PATENT DOCUMENTS

| | | | |
|---|---|---|---|
| 116,025 | 6/1871 | Clow et al.l | 417/379 |
| 3,937,599 | 2/1976 | Thureau et al. | 417/379 X |
| 4,033,118 | 7/1977 | Powell | 60/641.15 |
| 4,068,476 | 1/1978 | Kelsey | 417/379 X |
| 4,177,019 | 12/1979 | Chadwick | 417/379 |
| 4,309,148 | 1/1982 | O'Hare | 417/379 X |
| 4,347,045 | 8/1982 | Burnham | 417/379 X |

FOREIGN PATENT DOCUMENTS

| | | | |
|---|---|---|---|
| 941126 | 3/1956 | Fed. Rep. of Germany | 60/531 |

*Primary Examiner*—Leonard E. Smith

[57] ABSTRACT

The expansions and contractions of a diaphragm into and out of a pumping chamber for the purpose of pumping fluid from the chamber are provided by pressurizations and depressurizations against the diaphragm, produced by alternate vaporization and condensation of a volatile liquid which is moved to a vaporization chamber through two separate feed lines, one line carrying cooled liquid for condensing expanded vapor and the other line carrying liquid that is vaporized by a heat source immediately before entry to the chamber. The liquid flow through one feed line alternates with the flow through the other to provide first vaporization and pressure and then condensation and depressurization, and the heat application to the one liquid flow produces vaporization and pressure from the liquid as it enters the chamber in order to remove the requirement of a boiler or pressure storage tank. Since both the inlet and outlet of the small exciter pump that moves the streams of liquid to and from the chamber are always at approximately the same pressure as that in the chamber, the exciter pump energy requirement is very small.

10 Claims, 7 Drawing Figures

SOLAR DIAPHRAGM PUMP

This invention is a type of diaphragm pump that can be used for moving fluids of all kinds and it resembles a wide variety of conventional diaphragm pumps which operate by impelling fluid from a chamber through an exit check valve when pressure is placed on a diaphragm to move the diaphragm into the chamber. Different types of diaphram pumps can be distinguished one from another by the type of motive force that is applied to move the diaphragm into the pumping chamber. This present pump is like other diaphragm pumps which use alternations of fluid pressure to drive the diaphragm into the pumping chamber and subsequently retract it. During the retraction period the withdrawal action of the diaphragm from the pumping chamber expands the cavity of the pumping chamber and draws in fluid through an entry check valve. The fluid is then subsequently expelled by the following expansion of the diaphragm into the pumping chamber. The invention is not different from former art in using pressure alternations to move the diaphragm to and from the pumping chamber but it employs a novel means of providing the pressure alternations. In the former art the alternations of pressure for driving the diaphragm are provided by valving pressurized gas or vapor from a storage tank or from a boiler to a cavity where it intermittently expands the diaphragm. This present invention removes the requirement for any sort of pressurized gas reservoir as well as it removes the requirement for any sort of steam boiler. This innovation adapts the diaphragm pump ideally for use with solar energy in that even brief periods of solar radiation may be put to use to warm a small heat sink. The heat sink is then used to vaporize and pressurize a stream of liquid moving through it in order to immediately apply pressure and pumping action to the diaphragm of the pump. This has the advantage of utilizing solar radiation whenever it is available and of not having to wait for long periods of solar energy that are sufficient to heat an entire boiler before pumping can begin. This system also removes the expense of the boiler with large insulation requirement and it reduces the overall size of the pump. In this way this pump greatly resembles the boilerless steam displacement pump of my former invention of U.S. Pat. No. 4,309,148 called, "Pulsing Steam Solar Water Pump" as well as copending applications of Ser. No. 101,218, called, "Solar Water Pump and an application called, A Solar Displacement Pump." In the former art of these displacement pumps pressurizing vapor is condensed within the pumping chamber and it is condensed by the very water that is being pumped in order to provide the depressurization period that is required to draw in water into the pumping chamber prior to the pressurization period and steam is generated without the use of a boiler within the pumping chamber. But, unfortunately, in this former art even during the vaporization period within the pumping chamber much condensation is taking place while steam drives the water from the chamber because the steam contacts a large surface of cold water. This present invention remedies the inefficiency caused by unwanted heat loss of pumping steam condensing too rapidly when it could be used for additional impelling action. It does this by maintaining the boilerless feature of the former art while removing the contact with the large surface of cool water. In this present invention a diaphragm is interposed between the water to be pumped and the steam that displaces the water. The condensation of the steam required in the subsequent period is accomplished by water injection only during that period when depressurization is required. The cooling water for condensing steam as well as the water of the condensed steam is removed from the pressurization chamber to prevent unwanted condensation during the pressurization period. Also in this present invention the difficulties of heat transfer which derive from scale formation are eliminated and a more efficient boilerless pump results. In this present pump scale accumulation is prevented because very clean water can be used in a closed cycle. The water or other volatile fluid which is used to actuate the diaphragm is separated and isolated from that being impelled by the diaphragm. Since it is isolated and continually reused in a closed cycle, it is demineralized and kept clean so that scale formation is prevented on those surfaces which transfer heat. The more efficient heat transfer which results provides a more efficient engine.

One of the objects of the invention, then, is to provide a diaphragm pump with an integrated pressurization and depressurization system. Another object is to provide an integrated diaphragm pump capable of operating on thermal energy and without an external boiler or gas pressure reservoir. A further object of the invention is to provide a solar powered water pump. Still another object is to provide a closed cycle pressurization and depressurization system for a diaphragm pump in order to eliminate scale formation and thereby to increase pump efficiency by improving heat transfer.

Other objectives as well as novel advantages can be seen by referring to the drawings.

FIG. 1 of the drawings shows a diagram of a conventional diaphragm pump receiving pressurized gas and having its diaphragm expanded.

FIG. 2 of the drawings shows a diagram of a diaphragm pump during depressurization receiving water into its pumping chamber.

FIG. 3 of the drawings shows a pressurized box with a meter indicating high pressure, the box being connected to a heat source and a cooler.

Figure 1:
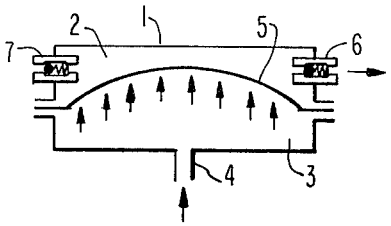

Referring then to FIG. 1, the conventional diaphragm pump 1 has a pumping chamber 2 and a pressurization chamber 3. When pressurized fluid is admitted to 3 through pressure inlet-exit duct 4, then diaphragm 5 is expanded by the pressure into 2 thereby forcing fluid from 2 through exit check valve 6 and closing inlet check valve 7.

Figure 2:
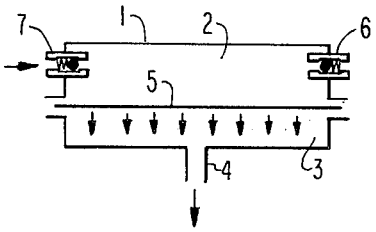

In FIG. 2 the elements are the same as those of FIG. 1 but the condition of some of the elements is changed to show the sequence of the process. The pressure on the pressurized fluid admitted through duct 4 has been reduced and under reduced pressure diaphragm 5 contracts moving back toward chamber 3 producing a flow out of inlet-exit duct 4 and creating a low pressure area within pumping chamber 2, closing exit check valve 6 and opening inlet check valve 7. The low pressure within 2 then draws in fluid through 7 filling 2. The fluid in 2 can then be expelled through 7 in a subsequent period. The alternate pressurizations and depressurizations of chamber 3 produce a pumping action in chamber 2.

Figure 3:
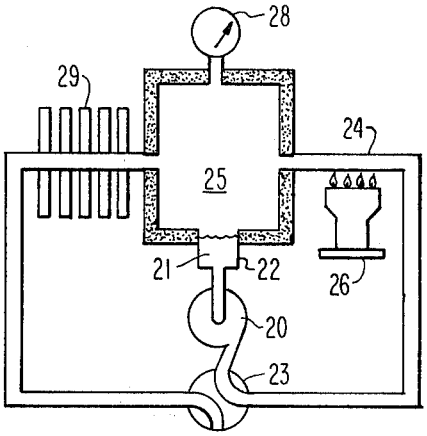

In FIG. 3 then is shown the first part of the process of producing the alternate pressurizations and depressurizations required for the pumping action of FIGS. 1 and 2. As stated, various means are available in prior art for generating the required alternations of repeated pressurizations and depressurizations, but the first part of the system of producing pressure alternations that is peculiar to this present invention is shown in this FIG. 3. Here exciter pump 20 receives volatile liquid such as water 21 from reservoir 22 and moves it through valve 23 and heater duct 24 into pressurization-depressurization chamber 25. Heater duct 24 converts the liquid to vapor and pressurizes the entire cavity composed of 20, 22, 23, 24 and 25 placing both the inlet and outlet of 20 at approximately the same pressure. For this reason exciter pump 20 does not have to pump liquid against the pressure within chamber 25 when 25 is pressurized but it has only to produce enough of its own small pressure differential as to circulate fluid within the pressurized area. For instance if the pressure within the pressurized area is 60 pounds per square inch, it is not required that pump 20 be capable of 60 psi pumping pressure, but rather 20 need only be capable of a few pounds per square inch in order to circulate fluid within the 60 psi pressure environment. Exciter pump 20 is a small pump such as a centrifugal pump with a very low energy requirement and capable of just a few pounds of pressure per square inch pressure output. Heat for vaporization and pressurization is supplied by burner 26 and the pressurized condition is indicated on meter 28. The cooler 29 is not being used during this period but will be used during a subsequent period described in the following FIG. 4. The cooling action of 29 has very little effect during the element conditions shown in this FIG. 3 because insulation 30 retards heat flow to 29 during this period.

Figure 4:
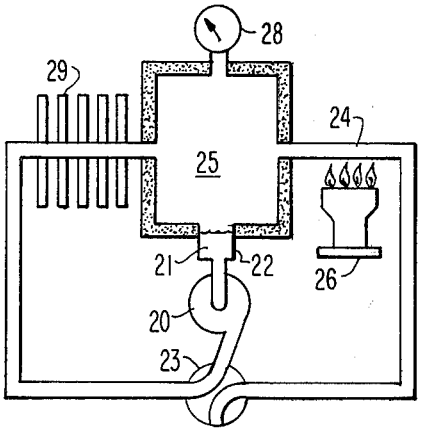
FIG. 4 shows a box with a heater, cooler and meter as in FIG. 3, but in this FIG. 4 the valve is open to the cooler and the pressure meter is low.

Now in FIG. 4, the elements of the drawing are all the same as the elements of FIG. 3 but the condition of some of the elements is changed. The condition of valve 23 has changed and fluid from reservoir 22 is now circulating through cooler 29 and into chamber 25 in which it cools the hot, pressurized vapors thereby condensing them and producing a depressurized condition. Since the condition of valve 23 is changed, the heating action of duct 24 and burner 26 has very little warming effect at this time. The heat flow is impeded by insulation 30 during this period. Meter 28 indicates the low pressure condition of the cavity composed of 20, 22, 23, 24 and 25 at this time. Again the inlet and outlet of exciter pump 20 are both at nearly the same reduced pressure and therefore the only energy required of 20 is that necessary to circulate the fluid within the reduced pressure environment. The pressure reduction mechanism described in this FIG. 4 follows the pressure increasing mechanism of FIG. 3 and the repeated cycling of valve 23 produces pressure alternations which are employed to actuate a diaphragm pump according to the mechanisms described in FIGS. 1 and 2.

Figure 5:
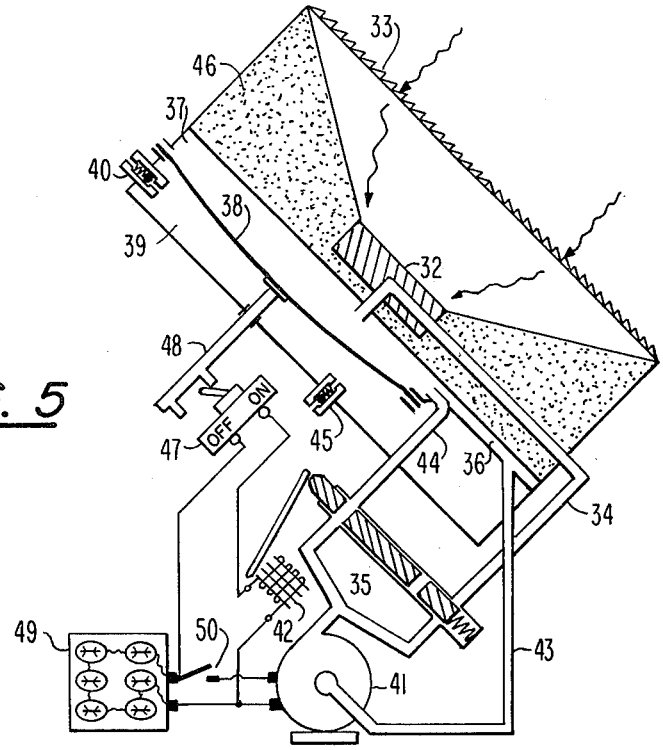
FIG. 5 shows a concentrating solar collector with a Fresnel lens and a heat sink mounted on a diaphragm pump with an electric valve and exciter pump.

In FIG. 5 the combined mechanisms are integrated into a solar powered thermal pump. In place of the combustion burner heat source used in FIGS. 3 and 4 a solar concentrator lens is used in this FIG. 5 as a means of heating the thermal mass 32. Lens 33 focuses light on 32 heating it. The heat in 32 is then periodically transferred to fluid in heat transfer duct 34 each time valve 35 opens fluid passage to 34. During each period of heat transfer the liquid fluid 36 in duct 34 is converted to vapor which expands and pressurizes chamber 37 driving diaphragm 38 into pumping chamber 39, forcing water or other fluid from 39 through outlet check valve 40. The energy to impel liquid 36 through 35 and 34 is derived from exciter pump 41. The inlet and outlet of 41 are always at approximately the same pressure as chamber 37. After 37 is pressurized and 38 has pumped water or other fluid from 39 then switch 47 turns off solenoid 42 and thereby changes the condition of valve 35. Then liquid cooled in ducts 43 and 44 is circulated by 41 to 37 condensing the pressurized vapor there and reducing the pressure. The reduced pressure in 37 retracts 38 and 39, drawing in water or other fluid through inlet check valve 45. During the condensation period heat transfer to 37 is curtailed by insulation 46. Sliding cam shaft 48 controls switch 47 turning it on at the period of maximum depressurization, leaving it on until the period of maximum pressurization and then turning it off and leaving it off until 38 is again at its farthest most retraction position from 39. At which time it again turns 39 on and so on. The solar electric cell bank 49 powers small electric pump 41 through electric switch 50.

While the operation of valve 35 is shown to be controlled by a sliding cam, 48; nevertheless, it is not intended to limit the inventive concept to the use of a sliding cam alone for this control, and in other embodiments can 48 is omitted and a pressure operated toggle switch is used in its place. The pressure in 37 is sensed by the pressure operated toggle switch and its contacts engage at a point of minimum pressure remaining closed to a point of maximum pressure. While the points are engaged a circuit is completed to an electric valve that is maintained in a condition directing fluid to the vaporizing heater and the pressurization chamber. When the switches contacts are disengaged the open circuit that results maintains the electric valve in a condition to direct the fluid to the fluid cooler and then to the chamber to depressurize it. The use of the pressure operated toggle switch is not shown in the drawings as it is felt that pressure switching is well understood art.

Figure 6:
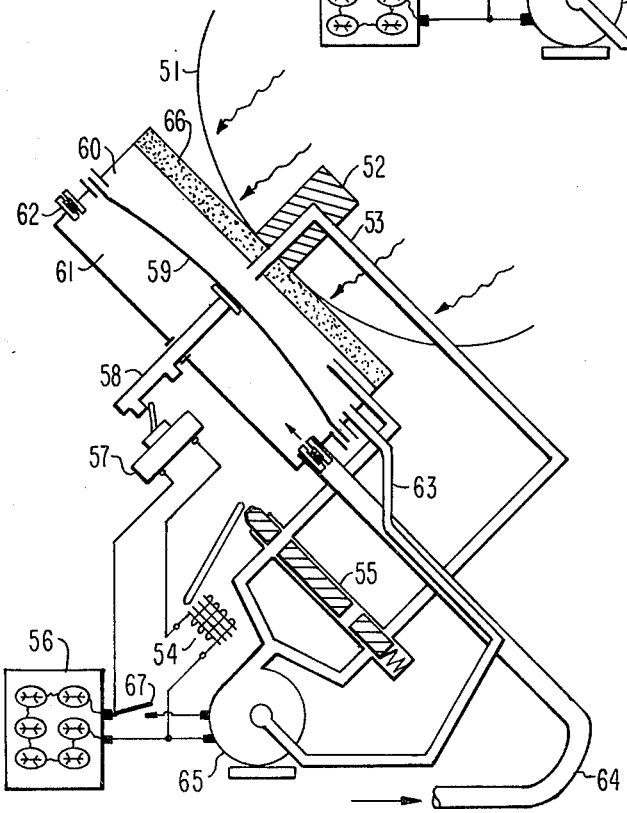
FIG. 6 shows a concentrating solar collector with a parabolic reflector and a heat sink mounted on a diaphragm pump with an electric valve and exciter pump.

Referring then to FIG. 6, the parabolic reflector 51 concentrates light energy on the thermal mass 52 heating 52. Heated volatile liquid circulates through duct 53 when the solenoid 54 of electric valve 55 is energized by current from photovoltaic cell array 56. The circuit necessary to complete the current flow to solenoid 54 is closed by switch 57 when sliding cam 58 attached to diaphragm 59 is moved to the right. The movement of 59 to the right is caused by a previous depressurization within chamber 60 and as 58 reaches a limit in its travel to the right, the closing of switch 57 and the energizing of 54 conditions 55 to admit the liquid fluid to 52 in which it is converted to a pressurized vapor to thereby drive 59 to the left and expell water from pumping chamber 61 through check valve 62. When 58 has reached the limit of its travel to the left, switch 52 is turned off by 58 and 55 is conditioned to admit cooled liquid to 60 condensing the vapor in 60 and depressurizing 60. The cooling of the liquid during this part of the cycle is accomplished in duct 63 as it passes through inlet water duct 64 and gives up heat to the water being pumped. The exciter pump 65 serves the same purpose as 41 of FIG. 5. The insulation 66 serves the same purpose as 46 of FIG. 5 In this FIG. 6 the switch 67 is the same as 50 of FIG. 5.

Figure 7:
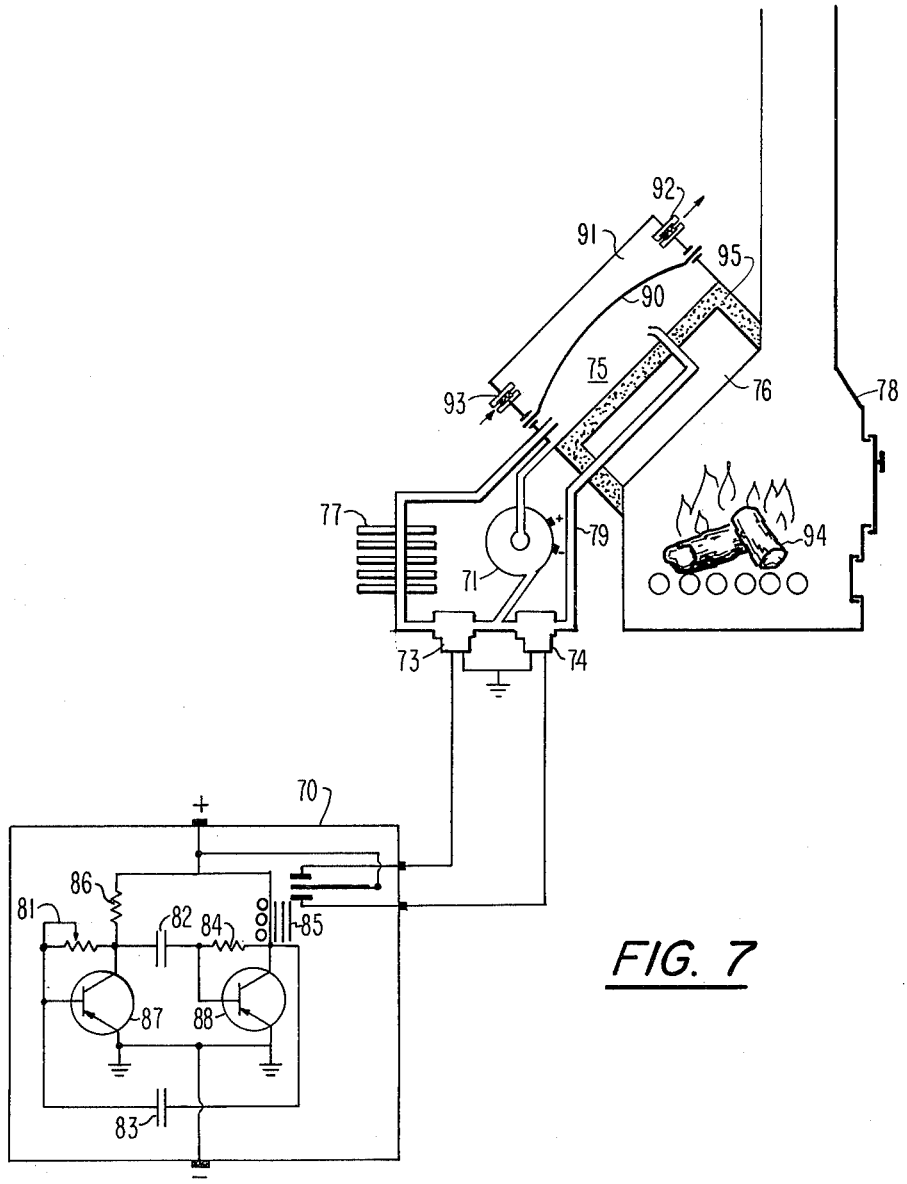
FIG. 7 shows a thermal powered diaphragm pump being driven by a combustion heater.

Referring then to FIG. 7, the astable multivigrator 70 is an electric oscillator which oscillates at a very slow rate. The time period of each oscillation is determined by approximately the time that is required for one complete pumping cycle. The time for a pumping cycle is determined by the size of the pumping diaphragm as well as by the size of the inlet and exit check valves and the height of the liquid column to be pumped, the amount of energy available etc. The oscillator 70 is adjusted to the best rate by means of variable resistor 81 and by the selection of the proper values of the base to collector capacitors 82 and 83 as well as by the value of the resistor 84. The size of the collector circuit relay 85 is determined by the amount of current which its contacts must carry. This in turn is determined by the size of the pump and the size of the electric valves to be operated by this relay 85. Resistance 86 is then made to be the same value as the resistance of 85 and transistors 87 and 88 are capable of switching sufficient current to operate 85. While 70 is oscillating and 85 is being repeatedly energized and deenergized the contacts of 85 direct current alternately to either one of two electric valves, 73 and 74. When the circuit to 73 is closed then valve 73 opens for fluid flow communication between exciter pump 71 and pressurization chamber 75 via thermal mass 76. Alternatively, when electric valve 74 is energized by 85 then 73 is deenergized and valve 74 places 71 in fluid flow communication with 75 via cooler 77. In this way there is an alternation of two different fluid flows into chamber 75 with each flow taking place at a different time. When 73 is open and 74 is closed the heat from furnace 78 to thermal mass 76 converts liquid in thermal duct 79 to vapor, pressurizing 75 thereby forcing diaphragm 90 against water or other fluid in pumping chamber 91 and expelling it through exit check valve 92. During the alternate period when 74 is open and 73 closed, the cooled fluid from 77 condenses the pressurized vapor in 75 removing the pressure from 90 and drawing in water through inlet check valve 93. The thermal energy to power the pump is symbolized by combusting wood 94 but this symbol is intended to denote any combustible fuel such as agricultural residue or gas from a methane generator or forest waste etc. In another embodiment geothermal heat is pumped into thermal mass 76 to warm it. In yet another embodiment 76 is placed at the focal point of a concentrating solar collector. Insulation 95 retards heat loss.

Throughout the various figures it is not intended to limit the inventive concept to the use of any particular working fluid, but rather any fluid which can be vaporized and condensed may be used for pressurization and depressurization of the pressurization chamber. It is not intended to limit the embodiment of FIG. 7 to the use of one type of current alternation system. The multivibrator is but one example of many electronic oscillators which are well known in the art and may be used in this application. In place of electronic oscillators mechanical devices to alternate current are employed in other embodiments. Some of these are cam operated switches actuated by a slowly rotating cam, the lobes of which alternately close one switch and open the other. In another embodiment a commutator is used in such a way that a brush engages one rotating contact during one half of a revolution and another rotating contact during the other half of the revolution. Each of these rotating contacts is attached to a slip ring on the same shaft. The current that is fed to the brush engaging the rotating contacts is switched back and forth between the two slip rings from which it is removed by two other brushes which are each connected to an electric valve such as valves 73 and 74 of FIG. 7. Finally it is not intended to limit the inventive concept to a particular source of electric power to energize the small electric exciter pumps and the electric valves and relays. Solar cells such as 49 of FIG. 5 can be used to power the electric elements of FIG. 7. In another embodiment a small thermopile receiving heat from furnace 78 is used to power the elements of FIG. 7. A thermopile is not shown as its use as an electric source is well understood in the current art. Similarly, in applications of low energy requirement a catalytic heater is easily used for both applying energy to a small thermoelectric generator to power the exciter pump, and the catalytic heater is then used as well to provide vaporization energy. In this case the thermal duct such as duct 79 of FIG. 7 is embedded in a catalytic bed and combustible gases or vapors are injected into the bed. In this way this pump may be effectively powered by such fuels as alcohol and propane, butane and similar fuels.

I claim:

1. A thermal powered diaphram pump comprising:

a fluid impelling means in the form of a chamber having inlet and exit check valves and having, as one of its walls, a diaphram capable of enlarging and of contracting the volume of the chamber by being extended into or expanded out of the chamber and, an alternating fluid pressurization and depressurization means in the form of a second chamber having as one of its walls said diaphram, and said pressurization means being capable of expanding said diaphram into and extracting it from the fluid impelling means said second chamber being in fluid flow communication with a fluid thermal vaporization means and said second chamber being in fluid flow communication with a fluid cooling means and, a liquid fluid circulating means in the form of an exciter pump capable of being in fluid flow communication through ducting and valving first, in one time period, with the thermal vaporization means and with the interior of the second chamber and then in an alternate, second, time period being in fluid flow communication with the cooling means and the interior of the same second chamber, said fluid circulation means thereby being capable repeatedly of first impelling fluid in one closed cycle through ducting and valving through said thermal vaporization means to the interior of said second chamber, and then later, in the second and alternate time period, being capable of impelling fluid in a closed cycle through ducting and valving to said fluid cooling means and on to the interior of the second chamber and, valve repeated switching means being capable of alternately providing fluid flow communication first to said vaporization means and then to said fluid cooling means.

2. A diaphram pump as in claim 1 in which the thermal vaporization means is heat transfer ducting embedded in a thermal mass that is positioned at the focus of a parabolic, concentrating solar collector.

3. A thermal powered diaphragm pump as in claim 1 in which the thermal vaporization means is heat transfer ducting embedded in a thermal mass that is positioned at the focus of a refracting lens, concentrating solar collector.

4. A thermal powered diaphram pump as in claim 1 in which the thermal vaporization means is heat transfer ducting embedded in a thermal mass that is positioned in a combustion furnace.

5. A diaphram pump as in claim 1 in which the fluid cooling means is heat transfer ducting extending into the fluid that is being pumped by the pumping chamber.

6. A diaphragm pump as in claim 1 in which the cooling means is heat transfer ducting superimposed with cooling fins.

7. A diaphragm pump as in claim 1 in which the valve switching means is a toggle switch operated by a sliding cam attached to the pumping diaphragm.

8. A thermal powered diaphragm pump as in claim 1 in which the repeated valve switching means is an electronic oscillator energizing and deenergizing a relay which alternately switches current to only one or the other of two electric valves opening one while it closes the other, then closing the one while it opens the other.

9. A thermal powered diaphragm pump as in claim 1 in which the valve switching means is a free running multivibrator electronic oscillator intermittently energizing a relay the contacts of which switch on one then the other of two electric valves in repeated alternations.

10. A thermal powered diaphragm pump as in claim 1 in which the thermal vaporization means is heat transfer ducting embedded in a thermal mass which is in turn embedded in a catalytic bed fueled with combustible gas.

* * * * *